United States Patent [19]

Krauss et al.

[11] 4,075,998

[45] Feb. 28, 1978

[54] ELECTRICAL ON-OFF-STARTING OPERATION CONTROL SYSTEM FOR ENGINES REQUIRING PRE-HEAT TIME, SUCH AS AUTOMOTIVE DIESEL ENGINES

[75] Inventors: Heinz Krauss, Stuttgart; Gunther Kauhl, Asperg; Leo Steinke, Waiblingen-Hegnach, all of Germany

[73] Assignee: Robert Bosch GmbH, Stuttgart, Germany

[21] Appl. No.: 765,832

[22] Filed: Feb. 4, 1977

[30] Foreign Application Priority Data

Mar. 19, 1976 Germany ..... 2611594

[51] Int. Cl.[2] ..... F02N 17/00

[52] U.S. Cl. ..... 123/179 H; 123/179 BG

[58] Field of Search ..... 123/179 B, 179 BG, 179 H

[56] References Cited

U.S. PATENT DOCUMENTS

| | | | |
|---|---|---|---|
| 1,269,637 | 6/1918 | Olmsted | 123/179 H |
| 2,251,630 | 8/1941 | Loeffler et al. | 123/179 H |
| 3,551,686 | 12/1970 | Koehler et al. | 123/179 H |
| 3,675,033 | 7/1972 | Richard et al. | 123/179 H |
| 3,708,683 | 1/1973 | Howland | 123/179 H |

FOREIGN PATENT DOCUMENTS

| | | | |
|---|---|---|---|
| 2,300,229 | 3/1976 | France | 123/179 H |
| 1,299,589 | 12/1972 | United Kingdom | 123/179 H |

*Primary Examiner*—Charles J. Myhre
*Assistant Examiner*—David D. Reynolds
*Attorney, Agent, or Firm*—Flynn & Frishauf

[57] ABSTRACT

To permit use of a standard starting switch customary in Otto engines to start automotive-type Diesel engines requiring energization of a glow plug, the "start" position of the control switch is unstable, for example spring-loaded, and returns the switch to "on" position upon release. The ON position also simultaneously forms the pre-heat switch position. The system includes a first relay having its connecting contacts connected to the glow plug and to a source of power, and a second relay forming a transfer switch with one terminal set connected as a self-holding circuit. The coil of the first relay is connected through the other set of transfer contacts of the second relay to the ON terminal of the switch to form the pre-heat circuit when the second relay is de-energized. The "start" position connects the starting motor. The coil of the second relay is energized from a common transfer junction either when the switch is in the "start" position or when a heater switch, included in the circuit of the glow plugs, has sufficient current flowing therethrough which also causes the glow plugs to become hot.

10 Claims, 2 Drawing Figures

Figure 1:
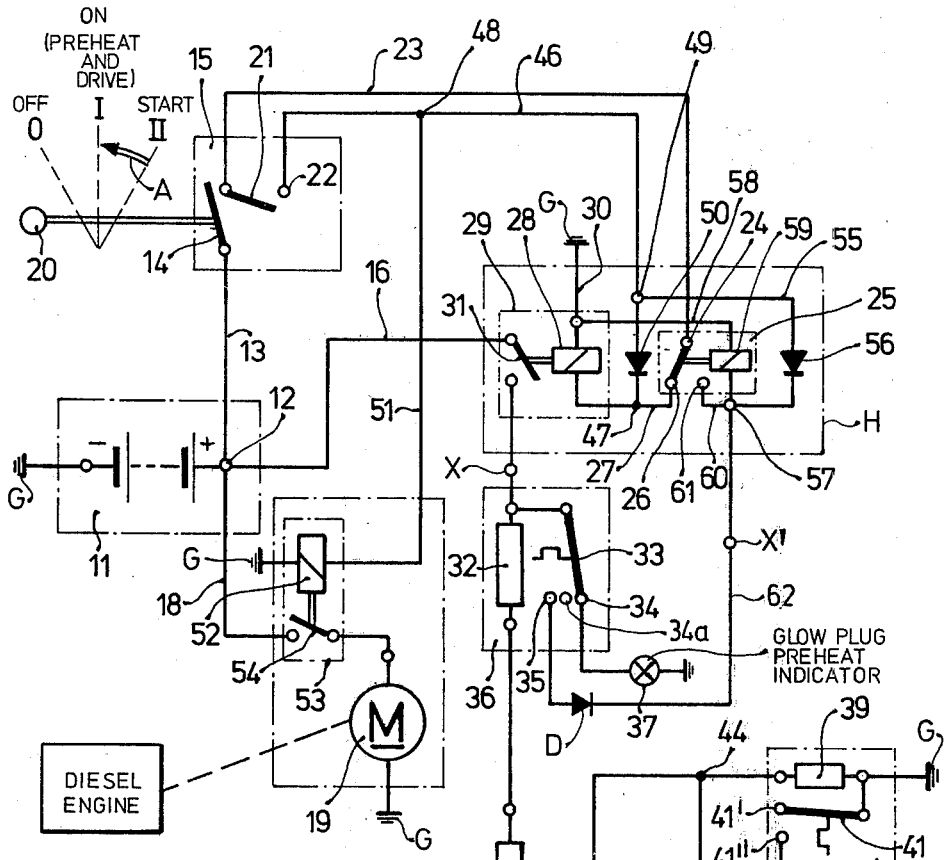

ELECTRICAL ON-OFF-STARTING OPERATION CONTROL SYSTEM FOR ENGINES REQUIRING PRE-HEAT TIME, SUCH AS AUTOMOTIVE DIESEL ENGINES

The present invention relates to an ON-OFF-START control system for combustion engines, and more particularly for internal combustion engines of the Diesel type, especially for automotive-type Diesel engines, and which permits use of a starter switch analogous to the starter switch employed in connection with customary automotive Otto-type gasoline engines.

Many Diesel engines, particularly automotive-type Diesel engines, are started this way: First, the Diesel engine is pre-heated by passing an electrical current through glow plugs mounted in the cylinders of the engine. When the glow plugs are hot, the starting switch is operated. The arrangement to supply current to the glow plugs must be so constructed that current does not flow continuously therethrough; it should, particularly, be so arranged that even if the operator of the engine, after pre-heating with the glow plugs, does not start the engine and forgets to disconnect the glow plug circuits, the glow plugs will automatically disconnect, so as not to burn out. The system should be essentially fool-proof. Additionally, it must meet the operating requirements. In dependence on ambient temperature and/or the temperature of the engine itself, a signal should be provided on the operator of the engine that the engine is warm enough to permit it to be started. The system and the switch in connection therewith should also permit starting the engine at any time - warm or cold.

An electrical starting system for Diesel engines has been described, for example, in German Disclosure Document DT-OS No. 1,958,443, to which British Specification G.B. No. 1,299,589 corresponds. This system requires a special type of switch which has a position additional to the customary starting or ignition switch position in internal combustion engines, namely a pre-heat position. This pre-heat position of the switch is unstable, like the starting position, so that the switching element itself is reset to a different position, typically the null position after the switch itself has been released.

It is an object of the present invention to provide a starting and operating switching system in which the switch itself which controls the starting and operation of the Diesel engine is constructed with switching position analogous to those used as ignition switches in connection with customary internal combustion engines operated with gasoline fuel, that is, engines of the Otto type.

Subject matter of the present invention:

Briefly, the operating and starting control switching system is arranged to energize a starting motor and, at the same time, provide for pre-heating of the glow plugs through a current integrating timing circuit, such as a heater wire in heat transfer relation to a bi-metallic switch, which determines when sufficient energy is supplied to the glow plugs so that they will be hot, simultaneously providing an indication that the glow plugs are heating; a relay interlock circuit initially permits current flow through the glow plugs when energized by the "start" position and includes a self-holding relay which permits instant re-connection of the glow plugs and the starting motor if it is desired to re-start the engine after having been stopped and while the engine is still hot.

The system can be used with glow plugs which are serially connected as well as with parallel connected glow plugs; in accordance with a feature of the invention, a supervisory indicator light can be provided in series with the serially connected glow plugs and energized through a rapid-heating bi-metal switch which is serially connected with the glow plugs. The current supervisory bi-metal-type switch and the indicator switch can be combined into a single unit while simultaneously providing current indication as well as a "ready" light; the switch is constructed as a transfer switch which is so connected that it is sensitive to current flow through the glow plugs as well.

Figure 2:
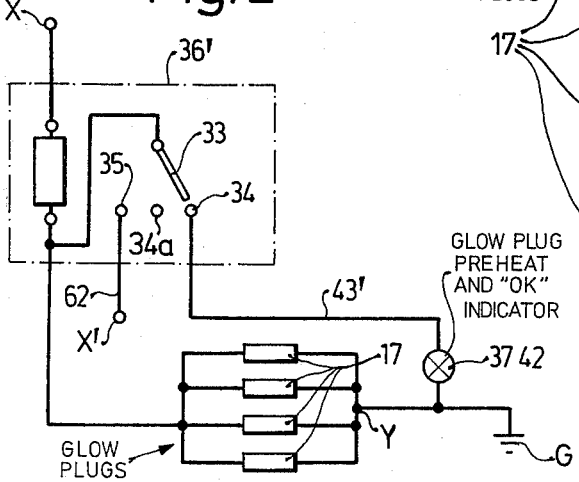

The invention will be described by way of example with reference to the accompanying drawings, wherein:

FIG. 1 is a highly schematic circuit diagram of the system in accordance with the present invention, in which elements not necessary for an understanding thereof have been omitted; and FIG. 2 is a fragmentary diagram of the circuit of FIG. 1, illustrating those portions which form a modification.

The system is energized by a battery 11, for example the battery of the vehicle, connected with one terminal to ground and with its positive terminal to a positive junction 12. Positive terminal or junction 12 has three lines branching off therefrom: Line 13 connects the ON-OFF-START switch 15, which can be manually operated by a manual operator 20, and more particularly to the movable element 14 thereof; line 16 connects through the operating terminal 31 to a junction X and then through a heater-type bi-metal switch 36 to serially connected glow plugs 17. Line 18 connects to the operating terminals 54 of the starter relay 53 and then to the starting motor 19. The ground or chassis connections throughout are indicated by G.

Operator 20 is connected to the movable element 14 of switch 15. The operator 20 which, for example, may be key-operated, can be placed in at least three position: A stable OFF or 0 position, in which the operating contact 14 is dead and not connected to any terminal; an ON or I position, which is likewise stable and also, simultaneously, forms the PRE-HEAT position; and an unstable START, or II position in which operator 14 is in communication with a terminal 22. Terminal 21 connected to the ON or I position is an elongated terminal. When the switch is in the START or II position, it bridges the sliding portion of terminal 21 and terminal 22 so that in the START position both terminals 21 and 22 are energized. Upon release of the switch from the START position, a spring or other bias loading returns the movable element 14 over the sliding portion of contact 21 to a stable engaged position with the contact 21. The reset force of the switch is schematically indicated by arrow A. The I position may also be referred to as the "pre-heat-and-drive" position. Switch 15 may be, as customary, associated with the control system of an automotive vehicle.

The sliding contact 21 is connected to a line 23 to which a transfer switch contact 24 of a relay 25, hereinafter referred to as a second relay 25, is connected. Transfer contact 24, in its quiescent position, that is, when the relay coil 59 thereof is de-energized, is connected as shown by connecting terminal 26 through a line 27 with the energizing coil 28 of a first relay 29. The energizing coil 28 has its other terminal connected through a line 30 to ground or chassis and controls current flow through a connecting contact 31 which is serially connected in line 16 from the battery to the glow plugs 17. Additionally, a resistor 32 of a heating switch 36 is serially connected in line 16. Resistor 32 forms, simultaneously, a heating element for a bi-metal switch 33 as well as a dropping resistor for the glow plugs 17. Bi-metal strip 33 forms a switch which has a quiescent contact 34 and an operating contact 35. Movement of the switch between contacts 34 and 35 is slow, schematically indicated by an intermediate position 34*a* which is not connected. The combination of the pre-heating resistor 32, the bi-metal strip 33 and its contacts 34, 35 form a glow plug supervisor 36 constructed as a unitary sub-assembly. It can be exposed either to ambient temperature in which the engine operates, or directly to the engine temperature itself, for example by being in thermal heat transfer relationship to the cooling fluid of the internal combustion engine, or by being exposed directly to motor block temperature. The bi-metal strip 33 is so constructed that it will interrupt contact 34 after a predetermined period of time depending on its surrounding temperature and after a further and second time delay makes electrical connection with contact 35. Contact 34 of the glow plug supervisor 36 is connected to chassis or ground through an indicator lamp 37, forming a glow plug pre-heat indicator.

The glow plugs 17 are serially connected, and the last glow plug in the series is connected to a line 38 which is connected through the heating resistor 39 of a rapid-operating bi-metal switch 40 and then to ground or chassis. Bi-metal strip 41 of switch 40 is serially connected with a glow plug OK indicator 42 and a line 43 connected to junction 44.

The START terminal 22 of switch 15 is connected to a line 46 which, after passing through the diode 50, terminates in a junction 47 connected to line 27. Additional junctions 48, 49 are provided in line 46. Junction 48 in line 46 connects with a line 51 which forms the current control line for the coil 52 of the starting relay 53. The starting relay, as customary, when energized controls terminal 54 to energize starting motor 19 by connection through line 18 to the positive terminal 12 of battery 11.

Diode 50 is poled in forward conductive direction with respect to battery 11. Just ahead of diode 50 in line 56 is junction 49 which forms the starting point for a line 55 which includes a second diode 56, likewise poled in conductive direction and connected to an energizing junction 57. Three lines branch off junction 57: Line 58 which connects through coil 59 of the second relay and provides the energizing line for the second relay, since the other terminal of the second relay coil 59 is connected to chassis; line 60, connected to the second, or normally open transfer terminal of the second relay 25; and line 62 which terminates at the working contact 35 of the glow plug supervisor element 36.

Operation: Let it be assumed that the Diesel engine, shown in block form and schematically only, is stopped and should be started. Prior to starting, the switches and relays will be in the position as shown in FIG. 1.

The operator moves terminal 14 from the OFF position through the ON position, forming simultaneously the pre-heat-and-drive connection to the START terminal 22. As the switch element 14 is moved to the I position, the following circuits will be established: Positive terminal 12 of the battery — line 13 — operator 14 of switch 15 — slider terminal 21. Current can thus flow: Battery 12 — switch 15 — line 23 — transfer terminal 24 of second relay 25 — line 27 — coil 28 of first relay 29 — G. Consequently, the switch terminal 31 of the first relay will close and current will flow: Positive terminal 12 of the battery 11 — line 16 — resistor 32 of glow plug supervisor 36 — four serially connected glow plugs 17 — line 38 — resistor 39 of switch 40 — G. Consequently, current can also flow from the energized connecting line 16 — bi-metal strip 33 — glow plug pre-heat indicator 37 — G. This causes the indicator 37 to light, and indicate to the operator that the pre-glowing, that is pre-heating step, has been initiated. Since current will flow through the glow plug 17, the resistor 39 of the switch 40 will also have current flowing therethrough and its bi-metal strip 41 will be heated rapidly and switch over from its rest terminal 41' to the working terminal 41''. Consequently, glow plug OK indicator 42 will light, indicating that current flow through glow plugs 17 and that they are not defective.

Bi-metal strip 33 of glow plug supervisor 36 operates as a time-temperature integrator; after elapse of a predetermined time which can depend on ambient temperature and/or motor temperature, strip 33 of the glow plug supervisor 36 will interrupt its connection with the normally connected terminal 34 and slowly switch over to the terminal 35. This causes indicator 34 to extinguish and, when the glow plug pre-heat indicator 37 goes out, it is an indication that the engine is ready to be started.

The operator can now move switch blade 14 from the stable position I to the unstable START position II. The movable terminal 14 will now connect terminal 21 as well as terminal 22 to the positive terminal 12 of the battery 11. Upon connection of the switch blade 14 with terminal 22 of switch 15, the following additional circuit will be established: Battery 12, switch 15, line 46; junction 48, line 51, energization coil 52 of starting relay 53. Starting relay 53 will close, establishing a direct connection from the terminal 12 through line 18 for starter motor 19, which will turn over to start the engine.

Additionally, the following circuit will arise: Line 46 — diode 50 — junction 47 — line 27 — coil 28 of the first relay 29 — line 30 — G. This circuit will hold the first relay in energized position. Further, junction 49 is now energized and the following circuit will establish: Line 46 — junction 49 — diode 56 — energizing junction 57 — coil 59 of the second relay 25 — line 30 — chassis G. Consequently, the transfer switch 24 of the second relay 25 will transfer from the first contact 26 to a second contact 61, forming a self-holding contact, so that the second relay 25 will be remain energized even after the switch has left terminal 22, that is, reverts to terminal 21 due to the following connection: ON position I — line 23 — terminal 61 — line 60 — energizing junction 57 — coil 59.

As soon as the engine has started, switch 15 can be released causing return of the movable terminal 14 to terminal 21. The switch is thus released from the start position back to the pre-heat-and-drive position I. The energizing coil 28 of the first relay is not connected, however, since the connection from line 46 and terminal 22 through the first diode 50 is interrupted, and line 23 — line 27 — junction 47 likewise are de-energized since the movable siwtch 24 of the second relay has transferred to its self-holding terminal, thus interrupting the connection between terminal 21 — line 23 — line 27. As a result, the terminal 31 likewise opens and interrupts current flow from battery 11 through the line 16 and resistor 32 to the glow plugs 17. Thus, although the switch 15 is in the I position, which provided for pre-heating when initially moved thereto, no more current is supplied to the glow plugs 17. Thus, the I position provides for pre-heating upon first connection of the glow plug and, after having moved the switch to the start position, interruption of the current to the glow plugs. The I position thus provides, simultaneously, the DRIVE position.

It may occur that the engine did not start upon moving the switch to the START or II position the first time. Upon moving the switch again to the START position, the starter motor 19 is again energized and the glow plugs 17 will again receive current through the circuits above indicated.

The transfer contact 24 of the second relay 25 reverts from its self-holding position to its rest position only after the engine is stopped, that is, switch 14 is moved to the OFF position, thus completely de-energizing the system.

It may occur that the engine is not started within a predetermined time delay, for example 15 seconds, after the glow plug pre-heat indicator 37 has indicated that the engine is ready for starting. After elapse of that time, the bi-metal strip 33 of the glow plug pre-heat supervisory element 36 deflects to form a connection with terminal 35 and current can flow as follows: Battery terminal 12 — line 16 — terminal 31 — junction X — strip 33 and terminal 35 — line 62 — energizing junction 57 — coil 59 of second relay 25 — G. Energization of the second relay 25 causes transfer of the transfer contact 24 and interruption of current flow between lines 23 and 27. Coil 28 of the first relay 29 will thus be interrupted and its terminal 31 will open. This breaks the connection to line 16 from battery 12 and hence the connection through the pre-heat resistor 32 and glow plugs 17. The transfer contact 24 of the second relay 25 connects line 23 with line 60, however, and hence permits energization of coil 59 of the second relay 25. The transfer terminal 24 will thus remain in the operated position even if the strip 33 of the glow plug pre-heat supervisor 36 no longer is in connection with transfer contact 35, due to cooling of the heating resistor 32. The plug indicator 37 likewise will remain extinguished since the bi-metal strip 33 has reverted to its normal of quiescent terminal 34 sine current supply through line 16 and the again open switch terminal 31 of the first relay 29 has been interrupted.

The engine can be started without pre-heating which is in order if the engine is still hot, that is, for example after having been operated and stopped temporarily. In such conditions of operation, the switch operator 20 is moved directly from the OFF position through the ON position to the START position II. Current will flow as follows: Battery 11 — switch 15 — terminal 22 — line 46 — diode 50 — energization coil 28 of the first relay 29 — G. Switch terminal 31 of the first relay will close causing current flow. Battery 12 — line 16 — glow plug pre-heat element 36 — glow plug 17 — line 38 — unit 40 — G. Further, junction 48 will be energized causing the starter relay 53 to be energized and the starter motor to start. If the glow plug pre-heat element 36 is in heat-conductive relationship to the motor, then the glow plug pre-heat indicator lamp will remain extinguished under such conditions — since it was assumed that the motor was still hot, which is the situation indicating readiness to start. If the glow plug pre-heat element 36 is not exposed to the engine temperature, but rather to ambient temperature, glow plug pre-heat indicator 37 will light although the engine is ready to be started anyway.

The system can be used not only for serially connected glow plugs but also for parallel connecting glow plugs. The overall circuit requirements are low, and can readily be assembled on a single circuit board in a single housing. Particularly, the first relay 29, second relay 25 and diodes 50 and 56 can be placed within a common housing H.

The system can be simplified somewhat as indicated, for example, in FIG. 2 which also shows the parallel glow plug connection.

The circuit is broken at terminals X–X′ and replaced by the circuit at FIG. 2, where the same connections are indicated at X, X′. Glow plug supervisor 36′, which can be connected as shown in FIG. 2 or between the glow plugs 17 and ground or chassis G, has its quiescent contact connected to a line 43′ which is serially connected to combine glow plug pre-heat and OK indicator 3742. The operated contact 35 is connected as before to line 62 and to terminal X′. The switch 40 is no longer used. The indicator 3742 immediately lights as soon as the switch is placed in the pre-heat-and-drive, or ON position and extinguishes after the pre-heat time, and thus indicates the starting readiness of the engine. If the glow plugs are serially connected, and the switch 36′ is connected between terminal Y and ground, the indicator will light only if all glow plugs are in order. If the glow plugs are parallel connected, as shown, and the switch 36′ is connected between junction Y and ground, then it will light brightly when all the glow plugs are in order, but dimly if one of them should be defective. The glow plug indicator preferably is an incandescent lamp, permitting ready indication since the light intensity of incandescent lamps drops off sharply with supplied voltage. If the indicator is connected as shown, i.e. the movable terminal connected behind the resistor 32, some indication of operability of all the glow plugs can also be obtained, although not as sharply as connection of the indicator 36′ between terminal Y and ground G. Connecting the glow plugs to ground with one terminal, however, may have construction advantages in some engines and with some types of glow plug.

The system is universally applicable, that is, for all types of internal combustion engines regardless of whether the glow plugs are serially or parallel connected. When serially connected, current control for the glow plugs can readily be provided by including the second switch 40 serially with the glow plugs to provide an additional OK indicator. Simplification can be obtained, however, by leaving off the glow plug OK indicator while still permitting indication or supervision of current flow to the operator by connecting the glow plug pre-heat element 36 or 36′ serially with the glow plugs, for example between terminal Y and ground, or as shown in FIG. 2, and connecting the quiescent or rest position or terminal 34 of the bi-metal strip 33 to a contact which includes a control indicator, the operated position of the bi-metal movable terminal contact strip 33 being connected to the energizing junction 57 for the second relay 25.

Various changes and modifications may be made within the scope of the inventive concept which, basically, is directed to a circuit using a standard switch and having a special logic switching sequence. The system and its logic provide an initial pre-heat function at the I position, and, after having moved the switch to START, a disabling connection to disable the pre-heat function when the switch reverts to the I position.

To prevent 'sneak circuits', suitably polarized diodes can be inserted as needed, and have been generally omitted from the drawing, since this is well known. One such diode is shown, for example as D serially inserted in line 62 between terminal 35 of glow plug supervisory element 36 and terminal X', and junction 57''.

We claim:

1. Electrical ON-OFF-START operation control system for engines requiring a pre-heat time before starting, such as automotive-type Diesel engines having a source of electrical power (11, 12);

a starter motor (M-19); and a starter switch means (18, 52, 53, 54) therefor selectively connecting the motor (19) to the source;

a manually operable control switch (15, 20) having the positions, in sequence; OFF (O); ON (I); START (II); and corresponding ON (21) and START (22) terminals and a movable switch member (14) connected to said source;

a glow plug energization circuit (X-17-38-G) including at least one glow plug (17) and a heating element (32) — temperature sensitive switch (36) in heat transfer relation to the heating element (32);

wherein, in accordance with the invention, the START position of the control switch (15) is unstable and includes means (A) biassing the switch to return to the ON position upon release of manual operation after having moved the switch through the ON position to the START position, said switch being connected to form in the single ON position simultaneously a pre-heat connection for the glow plug or glow plugs;

and wherein the system further comprises a first relay (29) having its relay terminals and switch element (31) selectively connecting the glow plugs (17) directly to the source (11);

a second relay (25) having transfer terminals (24-26; 24-61), one set (24-61) of which is connected in a self-holding circuit;

the coil (28) of the first relay (29) being connected (30-28-27-23) through the other set of transfer contacts (26-24) of the second relay (25);

a start control circuit (46-48-51) connecting said START terminal (22) of the switch (15) to the starter switch means (18, 52, 53, 54);

an energizing junction (57) connected to the coil (59) of the second relay (25) which, when energized, provides energization to the coil;

a diode (56) connecting (46-55) said START terminal (22) of the control switch (15) to the energizing junction (57);

and a further diode (50) connecting (46-49-47) said START terminal (22) of the control switch (15) to the coil (28) of the first relay (29).

whereby said further diode (50) and the connection thereof to the START terminal will be in parallel with the connection of the coil (28) of the first relay (29) through the other set (24-26) of the transfer contacts of the second relay (25), said diodes (56, 50) being poled in conductive direction with respect to said source;

said energizing junction (57) being further connected (60) to said one set of transfer contacts (24, 61) of said second relay (25) to form said self-holding circuit, and being additionally connected (X', 62) to said temperature sensitive switch (33, 36) to be energized thereby when the temperature to which said switch is exposed is above a predetermined level to provide energization current to the junction (57) and hence to the second relay (25) when the temperature as sensed by said temperature sensitive switch (36) is indicated to be adequate to permit starting and operation of the engine.

2. System according to claim 1, further comprising a glow plug indicator (37) in circuit with said temperature sensitive switch (36) and energized by said switch when the temperature to which it is exposed is below a predetermined level.

3. System according to claim 2, wherein the temperature sensitive switch is a bi-metal element switch exposed to engine temperature, and the switch is a transfer switch selectively energizing said glow plug pre-heat indicator (37) or said energizing junction (37), said glow plug indicator (37) being energized unless the glow plugs have a temperature sufficient to permit starting of the engine, and the switch has been moved from OFF to ON position but not yet to START position.

4. System according to claim 2, wherein the temperature sensitive switch is a bi-metal element switch exposed to ambient temperature, and the switch is a transfer switch to selectively energize said glow plug pre-heat indicator (37) or said energizing junction.

5. System according to claim 1, further comprising low resistance rapid operating switch means (39-41, 41', 41'') serially connected with the glow plug or glow plugs, and a glow plug OK indicator 42, operated by said switch means and energized upon proper operation of at least one of said glow plugs.

6. System according to claim 5, wherein said rapid-operating switch means comprises a rapid-heating resistor (39) and a rapid-operating bi-metal strip switch (40) effecting a connection from the glow plug or glow plugs through said glow plug OK indicator (42).

7. System according to claim 2, wherein the temperature sensitive switch (36) forms a glow plug supervisory element, serially connected between the glow plugs and the source (11, 12) and ground or chassis (G), the element including a heating resistor (32) and a bi-metal strip (33) having a rest terminal (34) connected to said glow plug indicator (37; 37, 42), and an operating terminal (35), said operating terminal being connected to said energizing junction (57).

8. System according to claim 7, wherein (FIG. 1) the glow plugs are serially connected and the glow plug supervisory element (36, 40) is connected between the last one of the glow plugs (17) and ground or chassis (G).

9. System according to claim 1, wherein (FIG. 1) a plurality of glow plugs are provided, respectively serially connected;

and the glow plug supervisory element (36, 40) is connected between the energized terminal (12) of the source (11, 12) and the first one of the glow plugs, the last one of the glow plugs in the series connection being connected to ground or chassis (G).

10. System according to claim 2, wherein (FIG. 2) the glow plugs are parallel connected;

and the temperature sensitive switch is a bi-metal element switch having a quiescent contact connected to said glow plug pre-heat indicator (37, 3742) and a working terminal (35) connected to said energizing junction, said bi-metal element switch including a heating resistor (32) connected serially with the parallel circuit connection of said glow plugs (17).

* * * * *